United States Patent [19]

Atago et al.

[11] Patent Number: 4,821,698

[45] Date of Patent: Apr. 18, 1989

[54] FUEL INJECTION SYSTEM

[75] Inventors: Takeshi Atago; Yasunori Mouri; Toshio Manaka, all of Katsuta, Japan

[73] Assignee: Hitachi, Ltd., Tokyo, Japan

[21] Appl. No.: 895,217

[22] Filed: Aug. 11, 1986

[30] Foreign Application Priority Data

Aug. 27, 1985 [JP] Japan ..... 60-186639

[51] Int. Cl.[4] ..... F02B 3/02

[52] U.S. Cl. ..... 123/478; 123/339; 123/436

[58] Field of Search ..... 123/339, 352, 340, 478, 123/445, 436, 472, 434, 438

[56] References Cited

U.S. PATENT DOCUMENTS

| | | | |
|---|---|---|---|
| 4,457,275 | 7/1984 | Husokai et al. | 123/339 |
| 4,457,276 | 7/1984 | Uoda et al. | 123/339 |
| 4,501,240 | 2/1985 | Aono | 123/339 |
| 4,563,989 | 1/1986 | Peter | 123/339 |
| 4,565,174 | 1/1986 | Suzuki et al. | 123/478 |
| 4,580,535 | 4/1986 | Danno et al. | 123/339 |
| 4,596,164 | 6/1986 | Hasagawa et al. | 123/478 |
| 4,640,244 | 2/1987 | Koika et al. | 123/339 |
| 4,646,698 | 3/1987 | Inoue et al. | 123/478 |
| 4,649,877 | 3/1987 | Yasuoka et al. | 123/339 |
| 4,700,675 | 10/1987 | Otobe et al. | 123/478 |

*Primary Examiner*—Raymond A. Nelli

*Attorney, Agent, or Firm*—Antonelli, Terry & Wands

[57] ABSTRACT

A fuel injection system of the type in which the opening time of a fuel injection valve is controlled on the basis of a predetermined program and in accordance with various operation parameters such as the intake air flow rate, engine speed and engine temperature. The system has a means for detecting at least one of the offset of the engine speed from a command speed and the engine speed variation per unit time, the data being used together with the above-mentioned operation parameters in controlling the opening time of the fuel injection valve.

5 Claims, 7 Drawing Sheets

| $\frac{dN}{dt}$ (rpm/40ms) | -84 | -56 | -28 | 0 | +28 | +56 | +84 |
|---|---|---|---|---|---|---|---|
| +84 | 0.93 | 0.94 | 0.95 | 0.96 | 0.97 | 0.98 | 0.99 |
| +56 | 0.95 | | | 0.973 | | | 1.00 |
| +28 | 0.96 | | | 0.987 | | | 1.01 |
| 0 | 0.98 | 0.986 | 0.994 | 1.0 | 1.006 | 1.013 | 1.02 |
| -28 | 1.00 | | | 1.016 | | | 1.04 |
| -56 | 1.01 | | | 1.032 | | | 1.06 |
| -84 | 1.02 | 1.03 | 1.04 | 1.05 | 1.06 | 1.07 | 1.08 |

ΔN(rpm)

FUEL INJECTION SYSTEM

BACKGROUND OF THE INVENTION

The present invention broadly relates to an internal combustion engine having a fuel injection system and, more particularly, to a fuel injection system which is suitable for use in an automotive gasoline engine which is specifically required to operate stably at low speed.

Automotive gasoline engines sometimes experience unstable operation when the engine speed is lowered by a release of the accelerator pedal, or when idling.

In order to overcome this problem, hitherto, it has been proposed to effect, when the engine speed is lowered, a rich compensation in response to an idle signal, as in Japanese Patent Laid-Open Nos. 231144/1984 and 30446/85.

Such proposed methods, however, do not contribute to improvement in the operation characteristics after the steady engine operation is achieved.

SUMMARY OF THE INVENTION

Accordingly, an object of the invention is to provide a fuel injection system which can ensure a stable engine operation at low speed by elimination of engine speed variation and surging, thereby overcoming the above-described problems of the prior art.

To this end, according to the invention, there is provided a fuel injection system of the type in which the opening time of a fuel injection valve is controlled on the basis of a pre-determined program and in accordance with various operation parameters, such as the intake air flow rate, engine speed and engine temperature. The system has a means for detecting at least one of the offset of the engine speed from a command speed and the variation in the number of engine revolutions per unit time, the data being used together with the above-mentioned parameters in controlling the opening time of the fuel injection valve.

DESCRIPTION OF THE PREFERRED EMBODIMENT

A preferred embodiment of the invention will be described hereinunder with reference to the accompanying drawings.

Figures 6, 7:
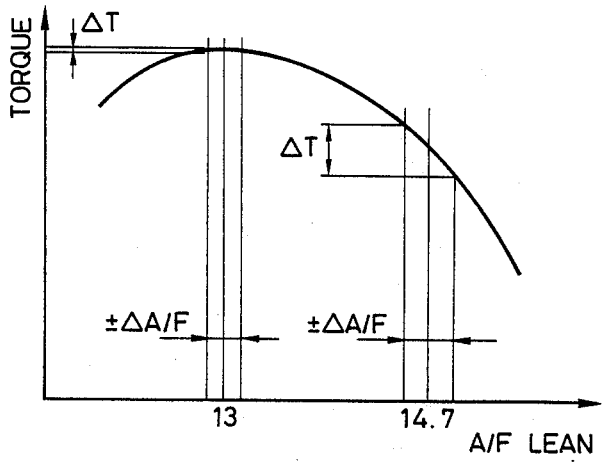
FIG. 6 is an illustration of a practical example of the map table.
FIGS. 7, 8 and 9 are illustrations of problems encountered in the conventional arts.

FIG. 7 shows air-fuel ratio to torque characteristic as observed in ordinary engines. As will be seen from this Figure, the change in the torque is minimized when the air-fuel ratio is around 13. Actually, however, the air-fuel ratio is set on the leaner side, e.g., 14.7 or greater, in order to meet various requirements, such as fuel economization and exhaust gas control. In consequence, the torque is largely changed even by a slight change in the air-fuel ratio, resulting in an unstable engine operation.

Figure 8:
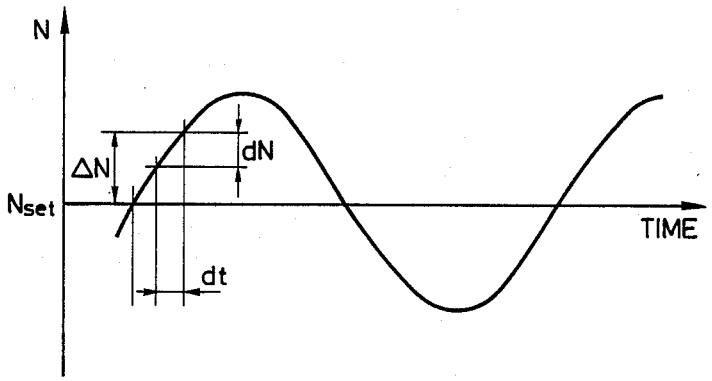

FIG. 8 shows an example of speed variation encountered by a conventional engine. It will be seen that a speed offset $\Delta N$ and speed variation $dN/dt$ are caused despite the fact that the engine is controlled to operate at a command speed Nset. It will be understood that the speed offset $\Delta N$ and the speed variation $dN/dt$ are minimized in engines which operate stably.

Figure 9:
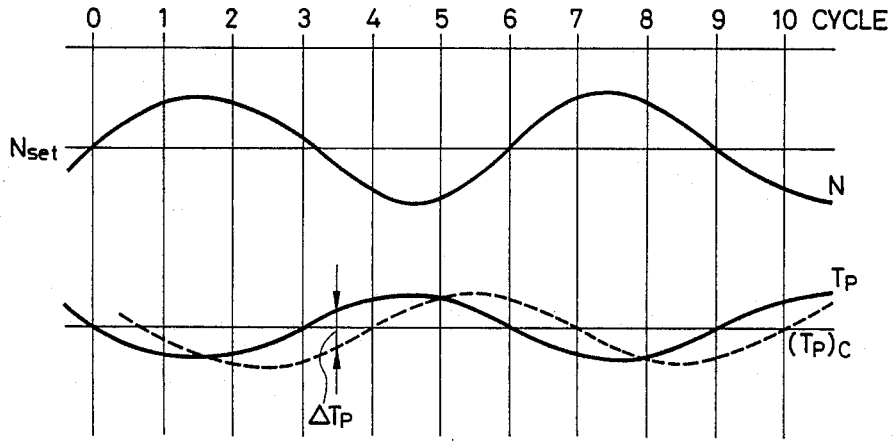

To explain in more detail with reference to FIG. 9, in the low-speed engine operation to which the present invention pertains, the throttle valve is fully closed so that the intake air flow rate can be regarded as being essentially constant, although the air flow rate through an idle speed control valve bypassing the throttle valve is changed.

Since air flow rate Qa is substantially constant, the valve opening time of the fuel injection valve, expressed by $Tp=Qa/N$, is determined in inverse proportion to the engine speed N.

To explain about the combustion in the engine, the fuel injected in the suction stroke produces the torque in the explosion stroke which is two strokes after the suction stroke. This means that the information signal concerning the combustion control lags by a time length corresponding to two engine strokes. Namely, the fuel is actually injected at a rate (Tp)c, when injection information Tp is given. In consequence, an error corresponding to the valve opening time $\Delta Tp$ is caused in the fuel supply rate, with a result that the air-fuel ratio A/F is offset correspondingly, leading to the change in torque as illustrated in FIG. 7.

According to the invention, the air-fuel ratio A/F is changed in such a manner as to suppress the error $\Delta Tp$ in the valve opening time.

An embodiment of the fuel injection system of the invention will be described in more detail with reference to the drawings.

Figure 2:
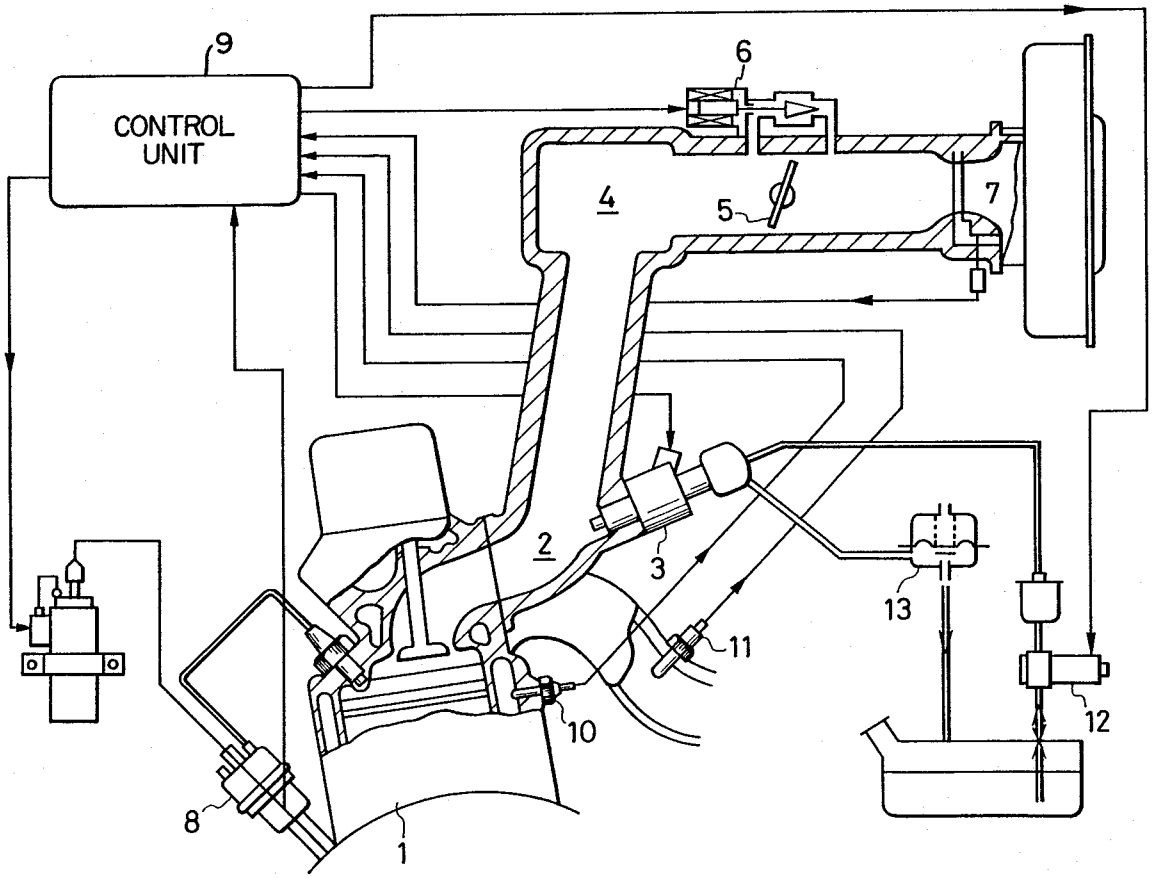
FIG. 2 is a block diagram of an engine system to which the invention is applied.

FIG. 2 shows an example of an engine to which an embodiment of the invention is applied. Referring to this Figure, an engine 1 is equipped with a plurality of injectors 3 provided on respective intake branch pipes 2. The number of the injectors corresponds to the number of the cylinders of the engine. The intake branch pipes 2 merge at their upstream ends in a common collector 4 which is disposed downstream of a throttle valve 5 for controlling the rate of flow of intake air to the engine.

At the same time, an ISC valve 6 for controlling the engine speed is provided in a passage which bypasses the throttle valve 5. When the throttle valve 5 is in the fully closed state, the speed of the engine 1 is controlled by this ISC valve 6.

On the other hand, the intake air flow rate of the engine 1 is detected by an air flow sensor 7 which is disposed upstream of the throttle valve 5, while the engine speed is detected by an engine speed sensor 8.

A control unit 9 receives, besides the intake air flow rate signal and the engine speed signal, other various signals such as signals from an engine temperature sensor 10, exhaust gas sensor 11, and so forth.

The supply of the fuel to the engine 1 is conducted by the opening and closing action of the fuel injector 3 to which the fuel is supplied after pressurizing and pressure regulation by a fuel pump 12 and a fuel pressure regulator 13.

Figure 3:
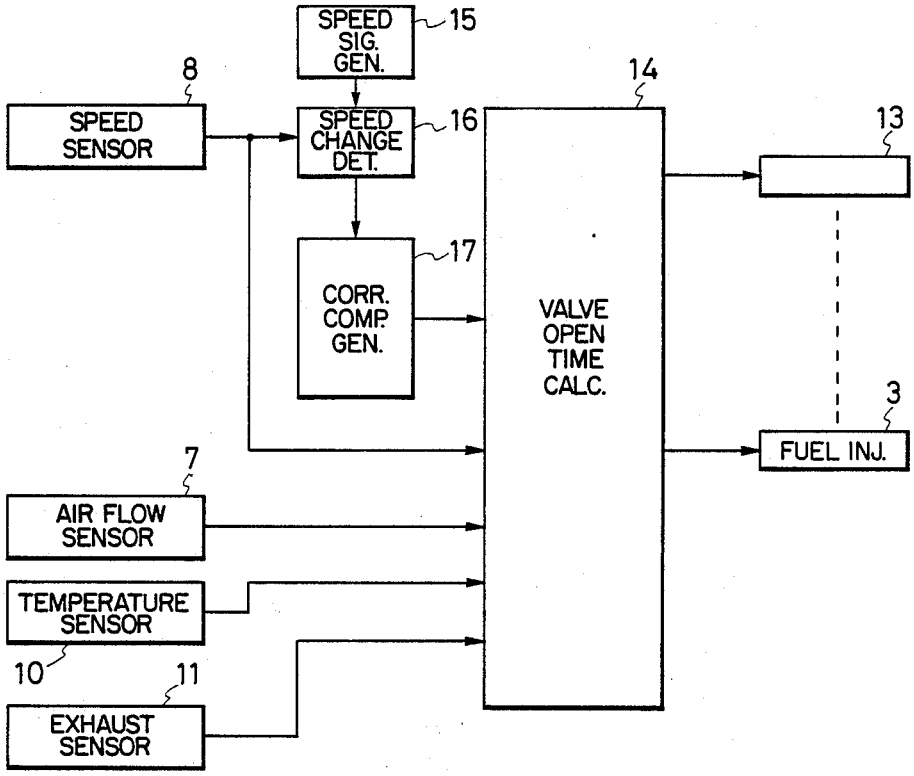
FIG. 3 is a block diagram of an example of a control unit.

FIG. 3 is a block diagram of a portion of the control unit 9 for controlling the fuel injector 3. This portion has a valve open time determining means 14 which receives operation parameter signals from various sensors such as the air flow sensor 7, engine speed sensor 8, engine temperature sensor 10, exhaust gas sensor 11, and so forth.

The engine speed signal from the engine speed sensor 8, corresponding to the actual engine speed, is delivered to a speed change detecting means 16 which is adapted to detect either one of the offset of the actual engine speed from the command speed set by a command speed setting means 15 and the variation of the engine revolutions per unit time. The data derived from the speed change detecting means 16 is delivered to a correction component generating means 17 which in turn is converted into a component for correcting the opening time of the fuel injector 3, as one of the operation parameters for the operation of the valve opening time determining means 14.

The operation of this embodiment will be described hereinunder.

In this embodiment, in view of the fact that the variation in the engine speed N and the variation in the air-fuel ratio A/F has a certain correlation, the air-fuel ratio A/F is changed in accordance with a change in the values of the speed offset ΔN and the speed variation dN/dt. That is, the final valve opening time Ti of the injector 3 is determined in accordance with the following formula.

$$Ti = Tp(1 + K_1 + K_2 + \ldots K_3 + K_{tp}) + Ts \quad (1)$$

In this formula, Tp represents the basic valve open time which is determined by Qa/N, while $K_1$, $K_2$ and $K_3$ are correction coefficients determined in accordance with the engine temperature. Ts represents a coefficient which is used for the purpose of compensation for the delay in the opening of the fuel injector 3.

The coefficient $K_{tp}$ is the one which constitutes one of the features in accordance with the invention.

A description will be made hereinunder as to the relationship between the air-fuel ratio A/F and the speed offset ΔN from the command engine speed Nset and the engine speed variation dN/dt. During idling and low-speed engine operation, the throttle valve 5 is closed almost fully, so that the intake air flow rate is maintained substantially constant. In this state, there is no reason for any change in the engine speed.

Actually, however, a speed variation is inevitably caused by any disturbance, such as a change in the air-fuel ratio.

The change in the engine speed can be sorted into two types: namely, static one and dynamic one.

The static change appears as the offset ΔN of the mean speed with respect to the command speed Nset. Usually, the offset ΔN is proportional to the airfuel ratio A/F. That is, the richer the air-fuel mixture, the greater the value of the speed offset ΔN. This relationship will be clearly understood from FIG. 4*a*.

On the other hand, the speed variation dN/dt is a dynamic speed change. When the value of this dynamic speed change becomes greater, the driver will feel the occurrence of surging. Both the speed offset ΔN and the speed variation dN/dt are detected by the speed change detecting means 16. In order to improve the drivability, it is necessary that the speed variation dN/dt is reduced. As explained before in connection with FIG. 9, the relationship between the speed variation dN/dt and the air-fuel ratio A/F is not a simple proportional relationship but the relationship is such that the dN/dt is largely changed even by a small change in the air-fuel ratio A/F.

Figure 1:
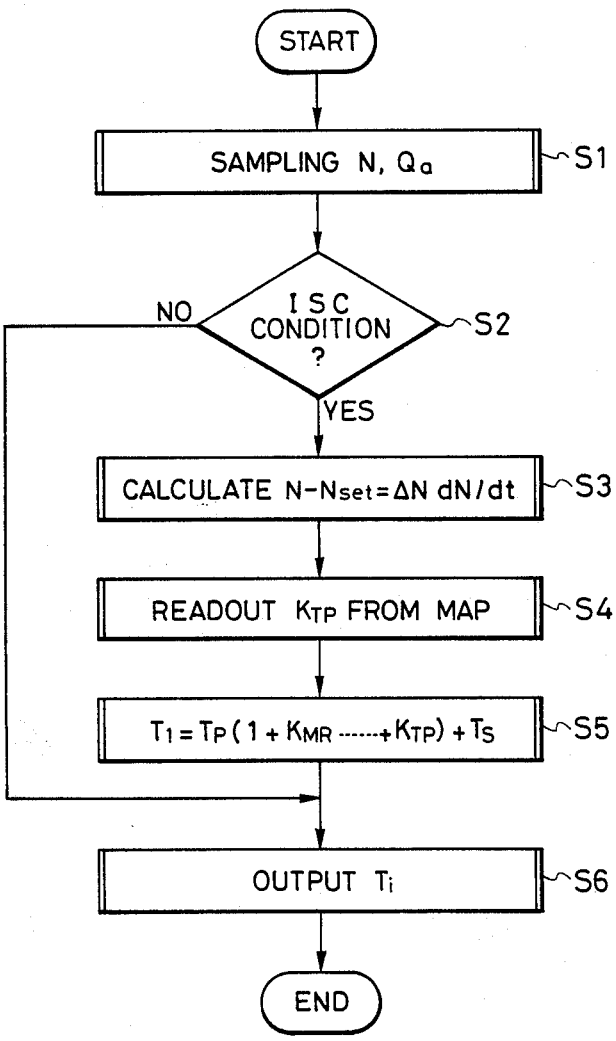
FIG. 1 is a flow chart illustrating the operation of an embodiment of the fuel injection system in accordance with the invention.
Figure 4:
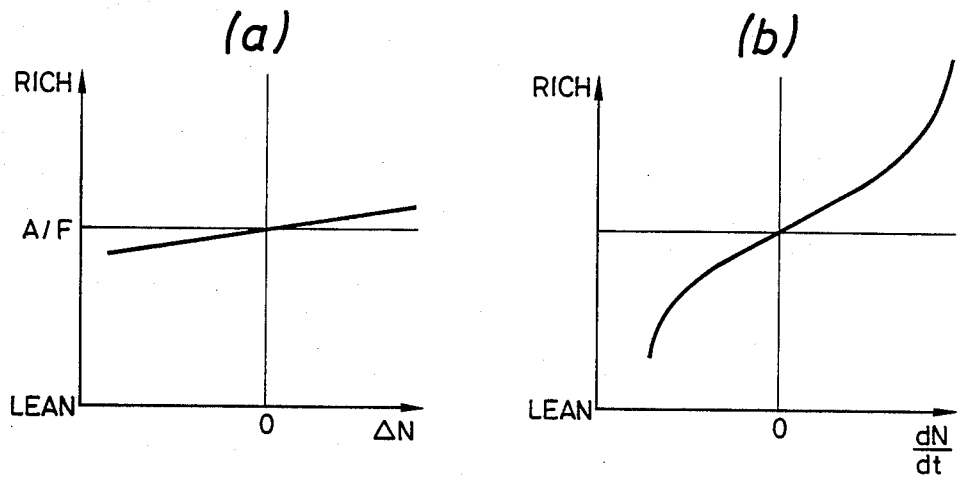
FIG. 4 is an illustration of the operation characteristics.

According to the invention, therefore, the correction coefficient $K_{tp}$ is given from the correction component generating means 17 in such a manner as to negate the change, in accordance with FIG. 4. More practically, this correction is effected by executing a process as shown in FIG. 1, by a CPU of the control unit 9, by making use of a map table as shown in FIG. 5.

Figure 5:
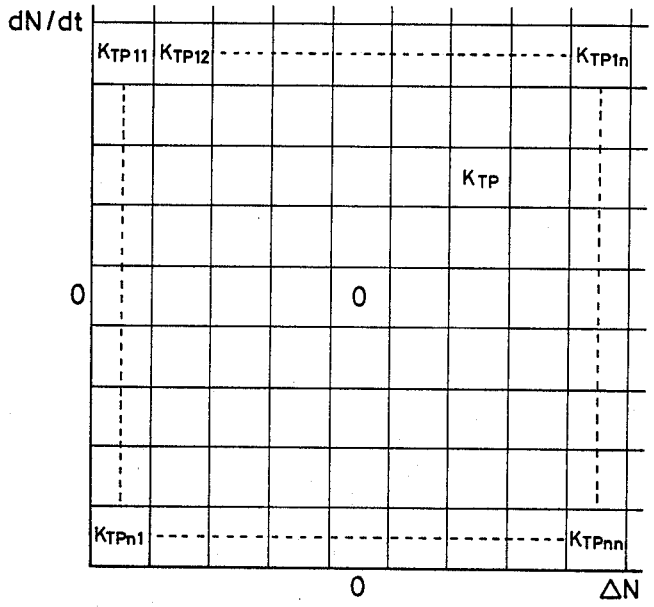
FIG. 5 is an illustration of an example of a map table.

The map table shown in FIG. 5 determines the coefficient $K_{tp}$, using the speed offset ΔN and the speed variation dN/dt as variables. Referring back to FIG. 1, the data N and Qa are picked up in Step S1 and, in Step S2, a judgement is made as to whether the ISC (Idle Speed Control) is operating. If the answer is YES, the process proceeds to Step S3 in which the data ΔN and the data dN/dt are determined and, in Step S4, the data $K_{tp}$ is determined through a search of the map table. Then, the valve open time Ti is computed in the process in step S5 and, in Step S6, a signal representing the valve open time Ti is delivered to the injector 3, thereby completing the process. On the other hand, when the answer to the inquiry in Step S2 is NO, i.e., when the ISC is not operating, the process directly proceeds to Step S6 in which the above-described operation is conducted to obtain the output data Ti.

FIG. 6 shows an example of the data content shown in the Table, as obtained through a test conducted using an automobile having a 2,000 cc engine. It will be seen that the range of the speed offset ΔN is +84 rpm (2%) while the range of the speed variation dN/dt is +84 rpm/40 mS (−0.07%). The use of this Table enables, even when a surging occurs, i.e., a large speed variation dN/dt, is caused, a correction to be effected by using the coefficient $K_{tp}$, so that the engine operation is converged towards the state of dN/dtk=0 and ΔN=0, whereby the surging is suppressed sufficiently.

Although the embodiment has been described with reference to the case where the engine system has an ISC function, i.e., the case of an engine system which operates in accordance with a command speed Nset, this is not an absolute requirement and the invention may be applied to the case where the data ΔN is not available. In such a case, the searching over the map table can be conducted solely by means of the data dN/dt.

Figure 10:
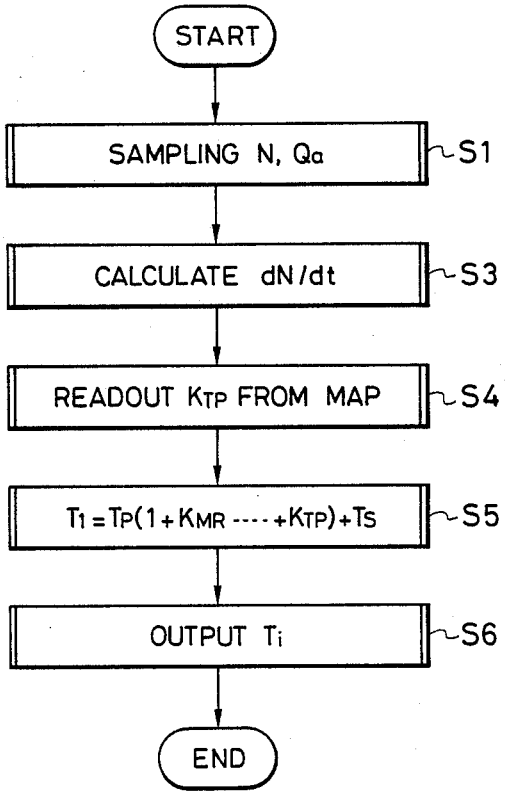
FIG. 10 is a flow chart of another embodiment.

Such a modification will be explained with reference to a flow chart shown in FIG. 10. Data N and Qa are picked up in Step S1, and, in Step S3, the speed variation dN/dt is determined. In a subsequent Step S4, a search over the map is conducted to determine the data $K_{tp}$. Unlike the map shown in FIG. 5 which makes use of both the speed variation dN/dt and speed offset ΔN, the map used in this modification makes use of the speed variation dN/dt as a sole variable. Then, the valve open time Ti is computed in Step S5, and the signal representing the valve open time Ti is outputted to the injector 3, thereby completing the processing.

As has been described, according to the invention, the air-fuel ratio is controlled in accordance with the speed offset and the seed variation, so as to enable control of the engine speed such that the speed converges to the level of the command speed. It is thus possible to avoid unfavourable operating conditions such as surging and others, thus enabling superior drivability.

What is claimed is:

1. A fuel injection system including valve opening time determining means for determining the opening time of a fuel injection valve in accordance with engine operation parameters which include intake air flow rate, engine speed and engine temperature, said fuel injection system comprising:

speed change detecting means for detecting variation in the number of revolutions of the engine per unit time;

correction component generating means for generating a correction component for correcting the opening time of said injection valve in accordance with the output of said speed change detecting means, including means for storing a map of correction component values which may be accessed by addresses based at least on said values of variation in the number of revolutions of the engine per unit time detected by said speed change detecting means; and means for supplying said correction component to said valve opening time determining means as one of the engine operation parameters.

2. A fuel injection system according to claim 1, wherein the value of said correction component is increased as the amounts of said variation in the number of revolutions of the engine per unit time are increased.

3. A fuel injection system including valve opening time determining means for determining the opening time of a fuel injection valve in accordance with engine operation parameters which include intake air flow rate, engine speed and engine temperature, said fuel injection system comprising:

speed change detecting means for detecting a first value indicating an offset of actual engine speed from a command speed and a second value indicating variation in the number of revolutions of the engine per unit time;

correction component generating means responsive to said first and second values detected by said speed change detecting means for generating a correction component for correcting the opening time of said fuel injection valve; and means for supplying a correction component generated by said correction component generating means to said valve opening time determining means for use in determining the operating time of said fuel injection valve.

4. A fuel injection system according to claim 3, wherein said correction component generating means includes means for storing a map of correction component values accessible by addresses based on said first and second values detected by said speed change detecting means.

5. A fuel injection system according to claim 3, further including an idle speed control valve which operates during idle speed control conditions, and means for inhibiting said supplying means when said idle speed control valve is not operating.

* * * * *